United States Patent [19]

Carlson

[11] Patent Number: 4,718,517

[45] Date of Patent: Jan. 12, 1988

[54] LOUDSPEAKER AND ACOUSTIC TRANSFORMER THEREFOR

[75] Inventor: David E. Carlson, Niles, Mich.

[73] Assignee: Electro-Voice, Inc., Buchanan, Mich.

[21] Appl. No.: 834,311

[22] Filed: Feb. 27, 1986

[51] Int. Cl.[4] ..... G10K 13/00; H04R 7/00

[52] U.S. Cl. ..... 181/159; 181/185; 381/156; 381/204

[58] Field of Search ..... 181/148, 155, 166, 171–174, 181/185, 186, 191, 199, DIG. 1, 159, 163; 381/153, 156, 158, 202, 204

[56] References Cited

U.S. PATENT DOCUMENTS

| | | | |
|---|---|---|---|
| 1,480,785 | 1/1924 | Semple, Jr. | 181/166 |
| 1,707,545 | 4/1929 | Wente | 181/159 |
| 1,930,915 | 10/1933 | Wente | 181/159 |
| 2,037,187 | 4/1936 | Wente | 381/156 |
| 2,107,757 | 2/1938 | Kinsley | 381/156 |
| 2,269,284 | 1/1942 | Olson | 381/204 X |
| 2,717,047 | 9/1955 | Buchmann | 181/166 |
| 2,745,508 | 5/1956 | Vadersen | 181/171 X |
| 2,763,333 | 9/1956 | Schumann | 381/204 X |
| 2,845,135 | 7/1958 | Cohen et al. | 181/163 X |
| 3,424,873 | 1/1969 | Walsh | 181/166 X |
| 4,050,541 | 9/1977 | Henricksen | 181/159 |
| 4,157,741 | 6/1979 | Goldwater | 381/156 |
| 4,478,309 | 10/1984 | Kawamura et al. | 181/166 X |

*Primary Examiner*—Benjamin R. Fuller
*Attorney, Agent, or Firm*—Darby & Darby

[57] ABSTRACT

A speaker system including a frusto-conical diaphragm, and a phase plug mounted within the volume formed by the diaphragm, the phase plug including a pair of substantially diametric open slots extending across the diaphragm and through the phase plug, with each of the slots having substantially rectangular cross sections transverse to the axis of the diaphragm.

13 Claims, 8 Drawing Figures

FIG. 5
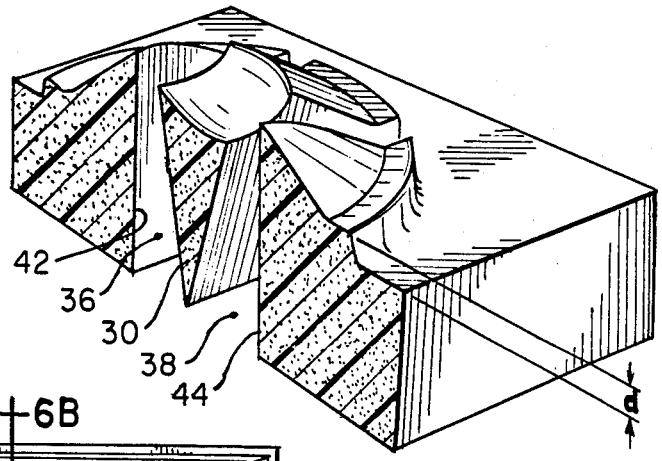
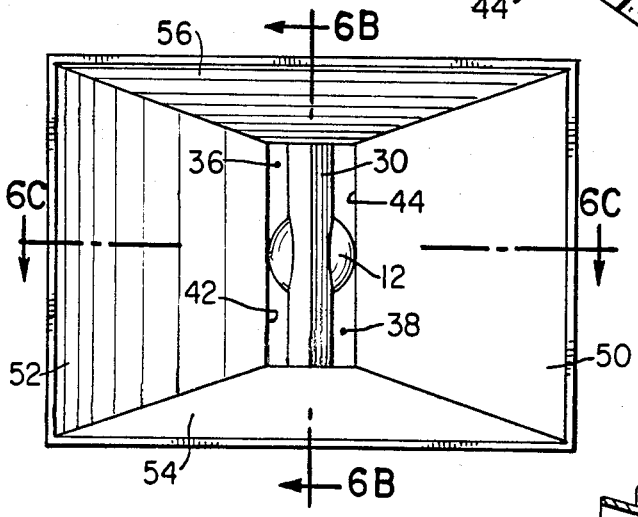
FIG. 6A
FIG. 6C
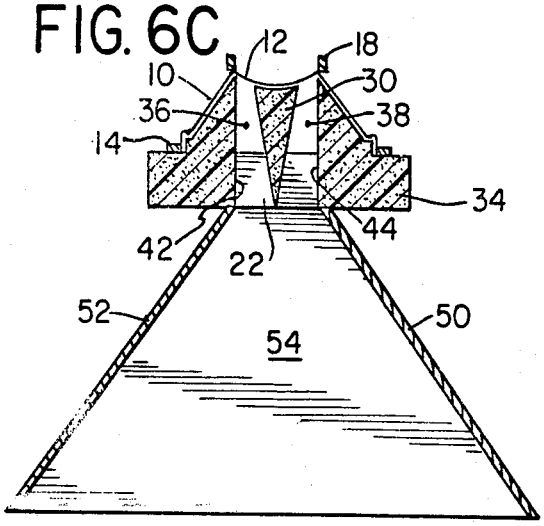
FIG. 6B
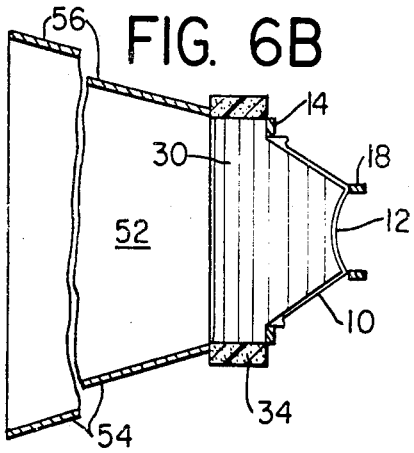

LOUDSPEAKER AND ACOUSTIC TRANSFORMER THEREFOR

BACKGROUND OF THE INVENTION a. Field of the Invention

This invention relates to a design for loudspeakers, and more particularly relates to apex-driven woofer or cone-type loudspeakers with an improved acoustic transformer or phase plug.

b. Description of the Prior Art

In certain loudspeakers, particularly of the horn type, an acoustical transformer (commonly known as a "phase plug") is used to match the acoustic output from the speaker diaphragm to the surrounding listening area, either directly or through a horn, typically mounted in front of the phase plug/diaphragm combination. A phase plug is generally an insert fitted within the concavity defined by a loudspeaker and positioned in proximity to the speaker diaphragm. It is used to attempt to bring all portions of the sound waves generated by the diaphragm into phase coherence at the outlet (usually the throat of a horn) and to minimize the volume of the air chamber between itself and the diaphragm.

In the prior art, phase plugs have had various configurations. One commonly used phase plug has been the "concentric" or annular type, illustrated in Goldwater U.S. Pat. No. 4,157,741 and the paper of Bob H. Smith entitled "An Investigation of the Air Chamber of Horn Type Loudspeakers", at page 305 of the March 1953 issue (Vol. 3, No. 2) of the Journal of the Acoustical Society of America. A second prior art type has been the radial or "tangerine" type, shown in Henrickson U.S. Pat. No. 4,050,541 entitled "Acoustical Transformer for Horn-Type Loudspeakers". Usual phase plug design theory requires that the phase plug be structured with one or a series of evenly spaced "loading slots" disposed across the sound-radiating diaphragm, such as those defined by the concentric ring formation of the annular plug design or the pie-wedge-shaped formations of the radial plug design. To extend the high frequency performance of a loudspeaker (or compression driver), according to the standard concepts of phase plug theory, the phase plug should be closely spaced to the speaker diaphragm, the distance between the loading slots should be minimized, and the sound travel path lengths should be equal. These concepts have traditionally been thought to hold true for all speakers, and phase plug designs have been scaled accordingly to accommodate various sizes of speaker.

It was found that the traditional phase plug theory is not applicable over the entire frequency range of a woofer-type loudspeaker and in particular, an apex-driven woofer. For example, for a woofer speaker in one commonly used design, having a single, outwardly widening annular slot which is defined concentrically by an outer plug portion and an inner, centrally positioned "bullet" plug portion, instead of the theoretical frequency response with a peak in the output at 1.5 kHz and a "hole" (i.e., sharp dip) at 3 kHz, the actual measured response, indicated an unexplained peak at 3.2 kHz and two unexplained holes at 1.5 kHz and 5 kHz.

It is believed that this discrepancy is caused by the fact that standard phase plug theory assumes that the entire speaker diaphragm is vibrating as one piston. If the diaphragm was not vibrating as a piston (for example, if only the center portion of the diaphragm were vibrating) then concentric acoustic standing waves could exist between the faces of the diaphragm and the phase plug. The nulls in these standing waves could cause the appearance of previously unexpected holes or peaks.

Explained differently, when the entire diaphragm is vibrating, the boundary conditions are such that concentric standing waves in the air cavity or chamber between the diaphragm and the phase plug may be suppressed. If, however, there was a single driving point at the center of the speaker diaphragm with the outer portions of the diaphragm motionless, the boundary conditions would be proper for exciting concentric acoustic standing waves, producing the series of undesirable, well defined nulls and peaks in the speaker's frequency response. This condition, where only the center of the diaphragm vibrates, occurs in the relatively higher frequency ranges of woofer or apex-driven cone-type loudspeakers, to which the standard phase plug theory appears no longer to apply.

OBJECTS AND SUMMARY OF THE INVENTION

An object of the present invention is to provide an improved phase plug design for use with woofer or cone-type loudspeakers that suppresses standing waves which may develop at higher operating frequencies, and improves the speaker response at the higher end of its frequency range.

Another object of the invention is to provide an improved phase plug design for use with woofer-type speakers that provides proper compression at higher frequencies and thus improves its higher frequency response.

A further object of the invention is to provide an improved phase plug that maintains phase coherency and a constant, non-shifting acoustic center at the outlet, over the entire frequency range of operation.

A still further object of the invention is to provide an improved phase plug design that is conveniently adapted for loading loudspeaker horns.

Yet another object of the invention is to provide an improved phase plug design for loudspeakers that overcomes the inherent disadvantages of prior proposed plug designs.

Still another object of the invention is to provide an improved driver, including a phase plug, for a rectangular acoustic horn.

In accordance with one embodiment of the invention, the usual phase plug for woofer-type loudspeakers is changed from its customary circular or annular sound transmission to a main portion positioned in close proximity to the diaphragm of the speaker, and having formed therein a rectangular channel or slot which extends diametrically across the diaphragm. This main plug portion includes a flat outer face and an inner face that conforms to the shape of the speaker to allow the plug to be closely positioned thereto. The periphery of the plug may conform in shape to the outer periphery of the loudspeaker. The main plug portion may also include a lip formed on the periphery of its inner surface, adapted for mounting the plug to the outer periphery of the speaker.

Preferably the width of the slot is dimensioned to be just slightly larger than the diameter of the dust dome at the center of the speaker cone. The main plug portion may be provided with outer sidewalls to extend the outer face of the plug portion beyond the outermost face of the speaker diaphragm.

In an improved form, an inner plug portion is positioned within the rectangular slot. The inner plug portion is preferably wedge-shaped in transverse cross-section. It includes sidewalls which mutually converge at a position at or near the outer face of the main plug portion, to provide two channels of expanding cross-section leading away from the diaphragm.

Alternatively, the inner plug portion may be formed with a bottom face of circular cross-section (positioned approximately at the speaker diaphragm) which smoothly transforms through converging flattened sidewalls into a peaked wedge tip (positioned distally from the diaphragm) that extends diametrically across the speaker. In such an embodiment, the interior surface of the main plug section is formed with a complementary shape so that the slots or channels defined between the inner and main plug portions have substantially equal width over their entire extent to provide a substantially rectangular sound outlet.

The present invention is particularly adapted to take advantage of the desirable vertical and horizontal directivity characteristics of well-known acoustic horns by providing a direct acoustic coupling from a cone-type or apex-driven speaker to the entry of a rectangular horn.

Preferred forms of the phase plug, as well as other embodiments, objects, features and advantages of this invention, will become apparent from the following detailed description of illustrative embodiments thereof, which is to be read in connection with the accompanying drawings.

DETAILED DESCRIPTION OF THE DRAWINGS

FIGS. 1A, B and C are respective diagrammatic front, vertical section and horizontal section views of one form of prior art speaker system or compression driver with a substantially rectangular baffle plate, providing a rectangular sound exit from a circular cone-type speaker.

FIGS. 2A, B and C are respective diagrammatic front, vertical section and horizontal section views of a form of speaker system or compression driver with one form of phase plug according to the present invention.

Figure 2:
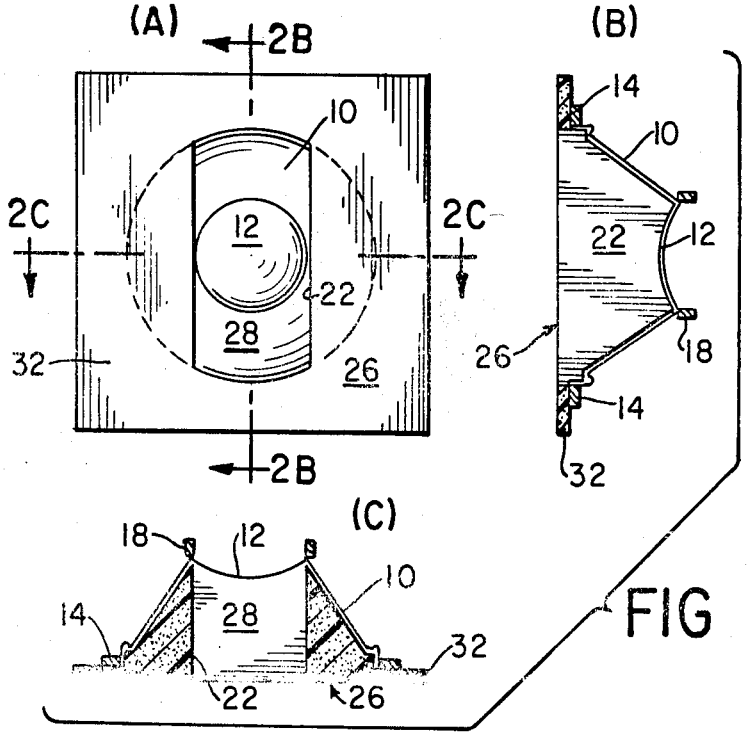

FIGS. 3A, B and C are respective diagrammatic front, vertical section and horizontal section views of a modification of FIG. 2.

Figure 3:
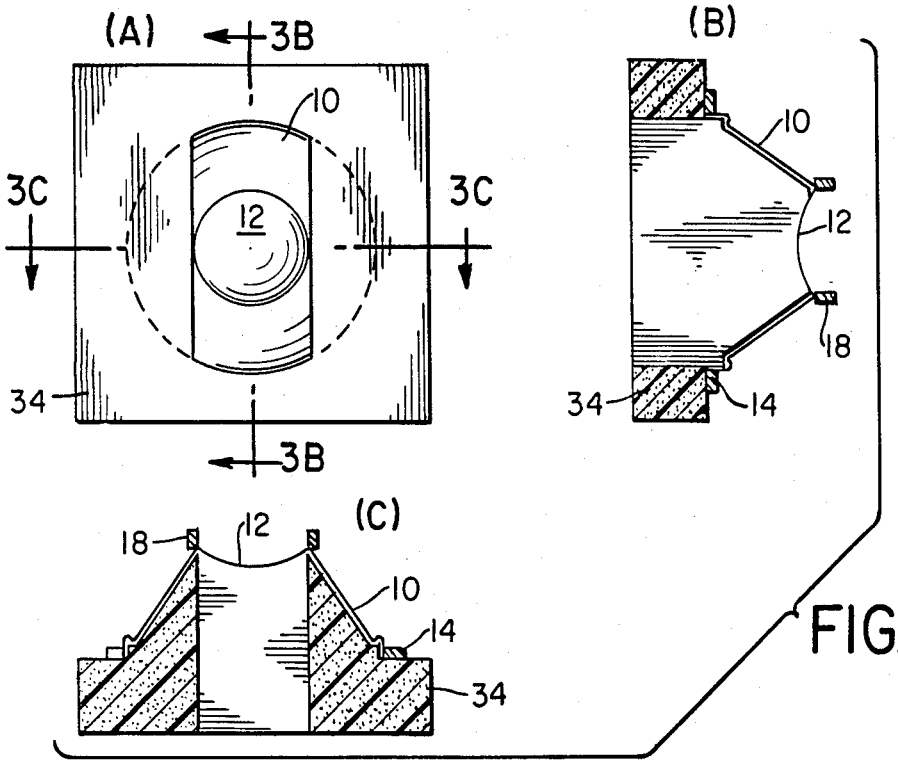

FIGS. 4A, B and C are respective diagrammatic front, vertical section and horizontal section views of a modification of FIGS. 2 and 3, with a phase plug including an interior wedge portion.

Figure 4:
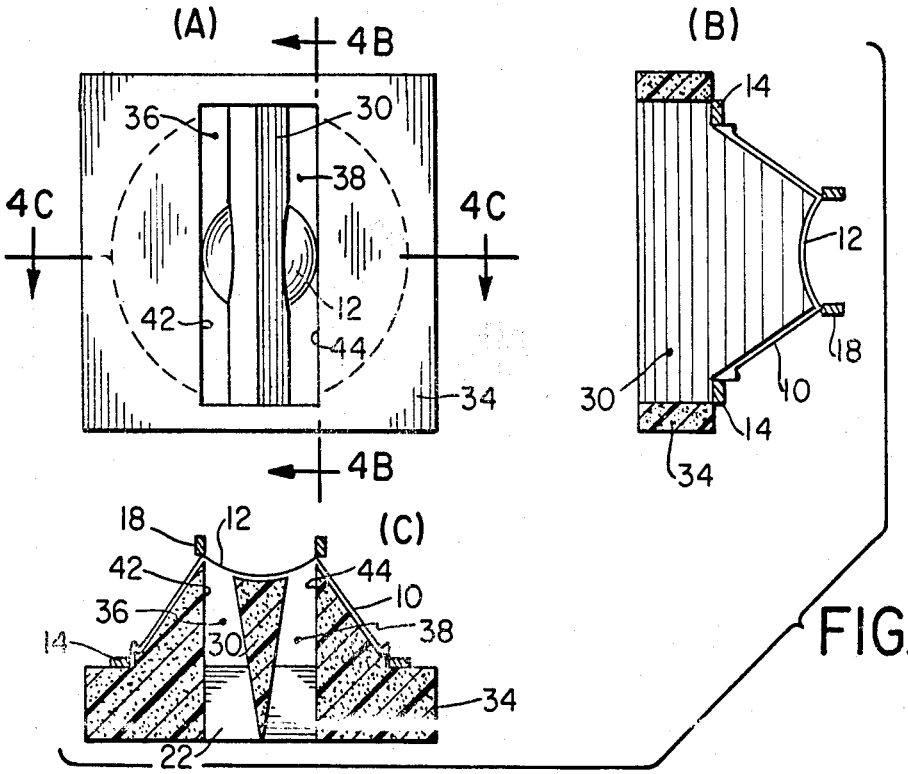

FIG. 5 is a perspective view, partly broken away, of phase plug of FIG. 4.

FIGS. 6A, 6B, and 6C are respective diagrammatic front, vertical section and horizontal section views, respectively, of a preferred embodiment of the invention coupled to a conventional speaker horn.

DETAILED DESCRIPTION OF THE PREFERRED EMBODIMENTS

FIGS. 1A, 1B and 1C show diagrammatically a rudimentary speaker arrangement having a speaker diaphragm 10 with a dust dome 12. The diaphragm 10 is of conventional frusto-conical shape, and has its outer periphery 14 connected to a supporting frame 14 which is in turn fastened to a rigid panel or baffle 16. As usual, the inner portion of the diaphragm is caused to vibrate by a voice coil 18 or the apex of the dust dome may be driven by a conventional arrangement.

The baffle panel 16 has a generally rectangular aperture 22, extending diametrically and symmetrically across the face of the diaphragm 10. This form of speaker system, while adapted to be coupled to a rectangular horn, has the drawback that the sound waves created by the diaphragm are reflected from the inner surface of the baffle plate, which has the effect of producing standing waves which cause peaks and holes in the frequency characteristics, particularly for frequencies above 1.0 kHz (for a 10-inch speaker). Additionally relatively poor compression characteristics are provided.

FIGS. 2A, 2B and 2C show diagrammatically an improved arrangement according to one aspect of the invention, in which the baffle plate 16 is replaced by a phase plug 26. The plug 26 is formed or molded from lightweight sound impervious material, such as polyurethane foam or polystyrene foam or the like. It nearly fills the hollow space of the diaphragm and dust dome, except that it is spaced by a narrow gap (illustratively 0.2 inch) from the diaphragm 10 to allow vibration of the diaphragm 10 and to maintain good compression at the lower frequencies where the entire diaphragm vibrates, like a piston.

The phase plug 26 has a central diametral uniform width channel 28 extending from the dust dome 12 to the exit opening 22 which, like in FIG. 1A, is substantially rectangular and may be an entry aperture for a rectangular horn. The opening 28 may have a length substantially equal to the diaphragm diameter (e.g., about 9 inches long for a 10-inch woofer) with ends rounded to substantially conform to the outer edge of the diaphragm. As before, this aperture 22 has a width substantially equal to or slightly wider than the dust dome (and may be about 4 inches wide for a 10-inch woofer), so that at higher frequencies (illustratively about 1000 Hz) where only the dust dome area of the loudspeaker diaphragm vibrates, the channel 28 serves as a diverging wave guide for sound waves to couple the dust dome to a horn entry.

Figure 1:
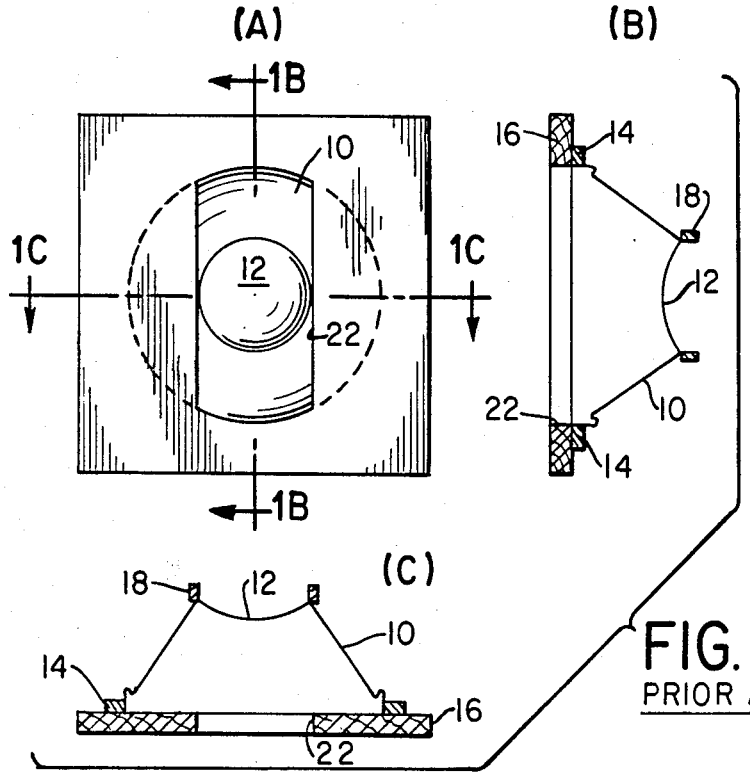
FIG. 1 PRIOR ART

In this form, the characteristics are improved over FIG. 1, by eliminating the reflection, by the inner side of the baffle 16, of sound waves emanating from the dome or diaphragm, which might cause standing waves concentrically of the diaphragm with consequent undesirable peaks and holes in the frequency characteristics.

Improvement may be attained over the structure of FIG. 2 by increasing the thickness of the portion 32 of the phase plug outside the speaker, as shown at 34 in FIG. 3. This thickness may be lessened or increased depending on the desired exit geometry and wave expansion rate.

Still further improvement is attained by adding to the structure of FIG. 2 or 3 a central wedge 30, as shown in FIGS. 4 and 5. Wedge 30 may illustratively have an approximate thickness of about $1\frac{7}{8}$ inch for a $4\frac{1}{4}$ inch outlet width, and straddles the dust dome 10, from which it is closely spaced, illustratively by 0.20 inch to form an air chamber and compression space therebetween. The width of the wedge may be selected to achieve the desired compression ratio. The faces of wedge 30 converge toward the outlet aperture 22, and may form a narrow edge at the plane of the outer surface of the phase plug 26. Alternatively, the wedge may terminate in a narrow flat outer surface in the plane of the plug outer surface, or may terminate either in a narrow flat surface or a sharp edge short of the plug outer surface. Typically the dimension "d" is determined by the mounting configuration used for the phase plug. The dimension "d" can be made deeper to accommodate a baffle board with a circular cutout, in order to provide for the baffle board supporting the weight of the speaker, and the phase plug.

The wedge thus forms two diverging channels 36, 38 between its respective side walls and the opposed wall of the main plug structure. These channels create a coherent phase for the sound waves exiting from the channels 36, 38, and minimize the peaks and holes in the frequency characteristics up to the usual roll-off at the high frequency end of the operating range.

While the inner walls 42, 44 of the main phase plug structure are shown as parallel to each other and the central axis of the speaker, these walls may diverge or even slightly converge, as needed to create the desired sound wave pattern.

Also, although the plug inner walls have been shown and described as spaced substantially equal to or slightly larger than the dust dome diameter, the present invention may be practiced, with somewhat poorer results, with a narrower spacing, illustratively down to about 2½ inches.

The form of FIG. 4 is preferred, because it properly loads the diaphragm at higher frequencies, and provides a better controlled roll-off at higher frequencies, although the forms of FIGS. 2 and 3 provide a greater response at higher frequencies, at the expense of a slightly more irregular response at such frequencies due to beaming out of the higher frequencies. The form of FIG. 4 also provides an advantage in off-axis response due to the greater coherence of the wave front emerging from the phase plug, so that constant directivity characteristics are provided to beyond 2 kHz. It also affords the opportunity to better fill a wider horn and for use in manifolding several speakers.

The present invention particularly offers advantage for woofer, cone-type or apex-drive loudspeakers, although it can be used for higher range speakers. In the low-frequency region (where the diaphragm essentially moves as a rigid piston) there is compression throughout the entire phase plug/diaphragm interface. In the high frequency region, where essentially only the center portion of the speaker is vibrating (as determined by the voice coil, dust dome and cone), with proper selection of slot width the phase plug will channel nearly all of the acoustic energy out of the slot. There will be compression only under the wedge, and the region of the diaphragm closely juxtaposed to the phase plug will be essentially non-operating. In the mid-frequency region, the slot arrangement breaks up any concentric standing waves (in the radial modes) and directs the acoustic energy out of the slot in a smooth transition from the low to high frequency range.

The present phase plug thus compensates for the fact that the diaphragm ceases to act as a piston at higher frequencies. It eliminates parasitic acoustic waves that result from mechanical modes of diaphragm vibration by breaking up and inhibiting the acoustic standing waves, and directing the acoustic energy out of the slot. It extends high frequency response by utilizing the fact that a smaller portion and hence less mass of the diaphragm vibrates at higher frequency (for moving-mass roll-off) and by having a decreasing compression at increasing frequency. The wedge at the center provides a substantially constant path length for higher frequencies radiating from the diaphragm as well as for low frequencies, maintaining phase coherency and a fixed acoustic center throughout the region of operation. The rectangular exit provides for convenient application to a variety of horn loading. In FIG. 6A, a conventional horn having side walls 50 and 52, a bottom wall 54, and a top wall 56 is mounted to the perimeter of the outlet aperture 22 of the phase plug embodiment of the invention shown in FIG. 4. FIG. 6B shows a vertcial sectional view of the mounting configuration thereof, whereas FIG. 6C shows a horizontal sectional view of the mounting configuration.

It is to be understood that the forgoing description is to be deemed only illustrative of the invention, which is defined by the appended claims.

What is claimed is:

1. A speaker system comprising a substantially frusto-conical diaphragm having a hollow space in front of said diaphragm, a predetermined diameter, and an open face, and means for inhibiting the effect of an acoustic concentric standing wave pattern in the space in front of said diaphragm, said means comprising a substantially solid phase plug structure spaced closely to said diaphragm in non-touching relationship, and largely filling the volume of the hollow space associated with said diaphragm, said plug including a centrally located open slot for defining a substantially rectangular aperture leading away from the open face of said diaphragm to the frontmost portion of said phase plug.

2. A speaker system as in claim 1 wherein said phase plug structure includes said rectangular aperture having a length substantially equal to the diameter of said diaphragm.

3. A speaker system as in claim 2 wherein said diaphragm has a circular dust dome at the center thereof, and said aperture has a width at least equal to a diameter of said dust dome.

4. A speaker system as in claim 1 wherein said structure conforms to the shape of the open face of said diaphragm, and has a substantially frusto-conical surface closely juxtaposed to said diaphragm, and substantially uniformly spaced therefrom, and said structure also having a channel extending from adjacent said dust dome to the open face of said diaphragm, said aperture having a substantially rectangular exit opening.

5. A speaker system as in claim 4 wherein said channel has side walls parallel to a center axis of said diaphragm.

6. A speaker system as in claim 4 wherein said channel has side walls diverging from a center axis of said diaphragm.

7. A speaker system as in claim 1 wherein said phase plug structure has a substantially rectangular outlet aperture and substantially parallel side walls.

8. A speaker system as in claim 7 further including a wedge within said channel, spaced from said side walls and providing a pair of expanding sound channels extending from said diaphragm to the exterior of said speaker system.

9. A speaker system comprising:

a frusto-concical diaphragm with a concavity formed in front of said diaphragm, a circular dust dome at the center of said diaphragm, and a substantially solid phase plug insert shaped for mounting within and substantially filling the concavity of, and in close proximity to, said diaphragm, said phase plug having a diametric slot therethrough forming a rectangular channel from said dome and diaphragm to an exterior surface of said speaker system, and a wedge in said channel for dividing said channel into a pair of expanding sound channels to said speaker exterior.

10. A speaker system comprising:

a frusto-conical diaphragm, and a substantially solid phase plug mounted therein, said phase plug including a pair of substantially diametric open slots extending across said diaphragm, said slots extending through said phase plug, and each of said slots having substantially rectangular cross sections transverse to the axis of said diaphragm.

11. A system as in claim 10 wherein said slots have progressively increasing cross-sectional area in the direction of sound propagation.

12. A system as in claim 11 wherein each of said slots has a pair of flat diverging walls.

13. A system as in claim 12 wherein said speaker has a substantially rectangular exit aperture adapted to be coupled to a rectangular horn.

* * * * *